United States Patent [19]

Strang

[11] 4,173,939

[45] Nov. 13, 1979

[54] TWO-SPEED TRANSMISSION

[75] Inventor: Charles D. Strang, Lake Forest, Ill.

[73] Assignee: Outboard Marine Corporation, Waukegan, Ill.

[21] Appl. No.: 880,038

[22] Filed: Feb. 22, 1978

Related U.S. Application Data

[63] Continuation of Ser. No. 729,379, Oct. 4, 1976, abandoned.

[51] Int. Cl.[2] ..... B63H 5/13

[52] U.S. Cl. ..... 115/17; 115/34 R; 74/336 R

[58] Field of Search ..... 115/12, 17, 18 R, 34 R; 74/322, 323, 324, 333, 335, 336 R, 336.5, 337, 340, 360, 398, 402, 403; 192/105

[56] References Cited

U.S. PATENT DOCUMENTS

| | | | |
|---|---|---|---|
| 2,219,812 | 10/1940 | Hochstetter | 74/336 R |
| 3,492,966 | 2/1970 | Kiekhaefer | 115/17 |
| 3,532,068 | 10/1970 | Lamburn | 115/34 R |
| 3,884,097 | 5/1975 | Avramidis et al. | 74/336 R |

*Primary Examiner*—Jesus D. Sotelo
*Attorney, Agent, or Firm*—Michael, Best & Friedrich

[57] ABSTRACT

Disclosed herein is a marine propulsion device incorporating a two-speed transmission including a first drive gear which is mounted for common rotation with an input shaft drivingly connected to an engine and which meshes with a first driven gear mounted for rotation coaxially with a drive shaft drivingly connected to the propeller shaft and further including a second drive gear which is mounted for rotation coaxially with and independently of the input shaft and which meshes with a second driven gear mounted for common rotation with the drive shaft. The drive shaft is drivingly connected to the first driven gear by a one-way, overrunning clutch and is driven by the input shaft through the first drive and driven gears at low and moderate engine speeds. At high engine speeds, a second clutch is actuated to drivingly connect the second drive gear to the input shaft and the drive shaft thereafter is driven by the input shaft through the second drive and driven gears which have a gear ratio greater than the gear ratio of the first drive and driven gears. The second clutch preferably is a centrifugal clutch which is arranged to provide automatic shifting between the first drive and driven gears and the second drive and driven gears at a predetermined engine speed.

20 Claims, 2 Drawing Figures

TWO-SPEED TRANSMISSION

This is a continuation of application Ser. No. 729,379, filed Oct. 4, 1976 now abandoned.

BACKGROUND OF THE INVENTION

The invention relates to transmissions and, more particularly, to two-speed transmissions for marine propulsion devices and the like.

The thrust requirement curve (thrust vs. speed) for planing boats propelled by an outboard motor or a stern drive propulsion unit has a marked hump at the point where the boat is starting to plane. The propeller ordinarily must absorb full engine power at rated engine r.p.m. and maximum boat speed. A conventional size propeller normally limits the r.p.m. during this critical time, thereby limiting the thrust developed. If the propeller is designed to permit the boat to "go over the hump" under relatively high load conditions, such as when water skiers are being towed, it will permit the engine to run at excessive speeds once the boat is planing and less power is required to drive the propeller.

This problem could be alleviated by using a propeller having an adjustable pitch; however, many years of development have failed to produce a practical and efficient adjustable pitch propeller.

Also, it is desirable for propulsion units used in racing boats to have a transmission which permits the boat engine to rapidly turn up to a full speed when accelerating out of a turn and then shift automatically to facilitate full speed operation after the boat is planing.

SUMMARY OF THE INVENTION

The invention provides a two-speed transmission which is particularly adaptable for a marine propulsion device, such as an outboard motor or a stern drive unit, and which is shiftable from a first gear ratio, permitting the engine to operate at a high speed while driving a drive shaft at a low speed, to a second gear ratio, permitting the drive shaft to be driven at a higher speed without increasing the speed of the engine.

More specifically, the invention provides a two-speed transmission including an input shaft adapted for connection to a power source, a drive shaft, a first drive gear mounted for common rotation with the input shaft, a second drive gear mounted for rotation coaxially with and independently of the input shaft, a first driven gear mounted for rotation coaxially with the drive shaft and disposed in enmeshing engagement with the first drive gear, a second driven gear mounted for common rotation with the drive shaft and disposed in enmeshing engagement with the second drive gear, the gear ratio of the second drive gear to the second driven gear being greater than the gear ratio of the first drive gear to the first driven gear, first clutch means operable for drivingly connecting the first driven gear to the drive shaft to afford rotation of the drive shaft in one rotary direction through the first drive and driven gears and to permit rotation of the drive shaft relative to the first driven gear when the drive shaft is rotated at a rate greater than the rate of rotation of the first driven gear, and second clutch means for selectively drivingly connecting the second drive gear with the input shaft whereby the drive shaft thereafter is rotated, in response to rotation of the input shaft, through the second drive and driven gears and independently of the first drive and driven gears.

The invention further provides a marine propulsion device including a lower unit and a two-speed transmission described in the preceding paragraph. The drive shaft is rotatably mounted in the lower unit and is drivingly connected to a propeller shaft which is rotatably mounted in the lower unit and carries a propeller.

In accordance with one embodiment, the second clutch means for selectively connecting the second drive gear to the input shaft is operable, in response to rotation of the input shaft, to drivingly connect the second drive gear to the input shaft when the input shaft is rotated above a predetermined speed, thereby providing automatic shifting to the higher gear ratio.

In accordance with another embodiment, the second clutch is a centrifugal clutch which is carried by the input shaft and includes means operable, in response to rotation of the second drive gear, for drivingly connecting the second driven gear to the input shaft when the rotational speed of the second drive gear exceeds a speed corresponding to the predetermined input shaft speed.

One of the principal features of the invention is the provision of a marine propulsion device including a simple two-speed transmission which can be conveniently shifted to a higher gear ratio.

Another of the principal features of the invention is the provision of a marine propulsion device including a two-speed transmission which is arranged to prevent engine overspeeding at full throttle and maximum speeds of a planing boat.

Another of the principal features of the invention is the provision of such a marine propulsion device including such a transmission which automatically shifts between two different gear ratios at a predetermined engine speed.

Another of the principal features of the invention is the provision of a two-speed transmission which is particularly adaptable for use in marine propulsion devices and the like and which includes separate sets of drive and driven gears for drivingly connecting a drive shaft to an input shaft and means for shifting from one set of gears to another.

Other features and advantages of the invention will become apparent upon reviewing the following detailed description, the drawing, and the appended claims.

Figure 2:
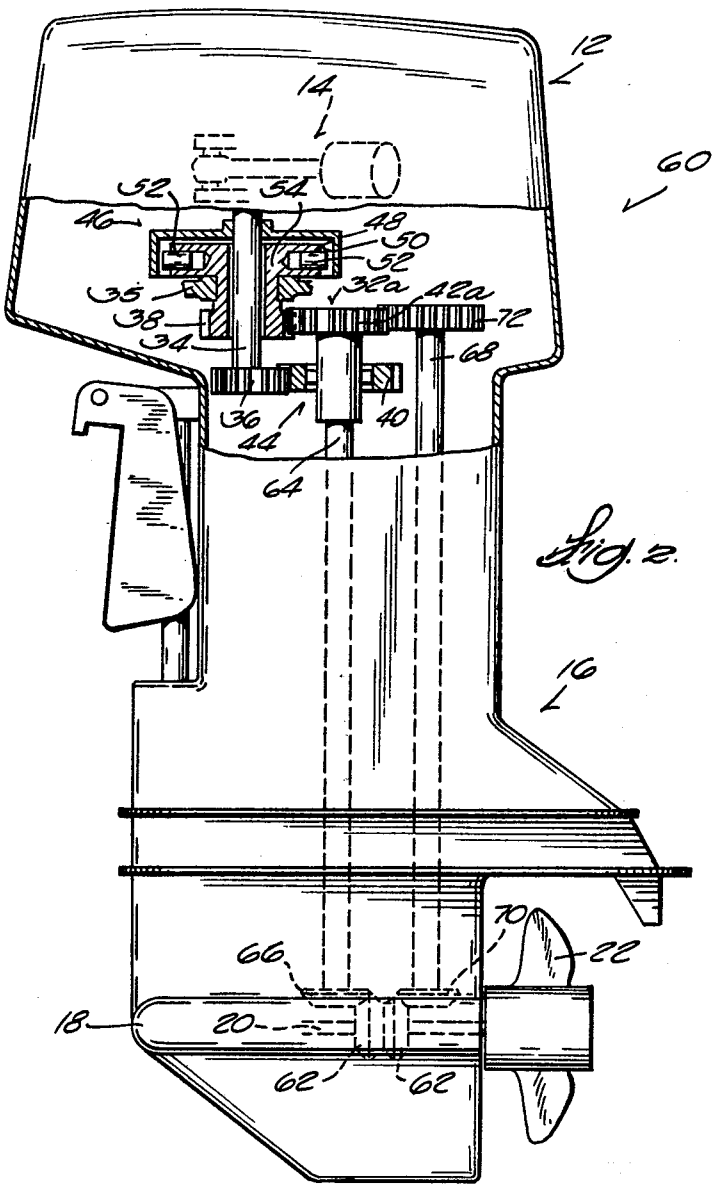
FIG. 2 is a side elevational view, partially broken away and partially in section, of another embodiment of an outboard motor embodying various of the features of the invention.

Before explaining preferred embodiments of the invention in detail, it is to be understood that the invention is not limited in its application to the details of construction and the arrangements of the components set forth in the following description or illustrated in the drawings. The invention is capable of other embodiments and of being practiced and carried out in various ways. Also, it should be understood that the phraseology and terminology employed herein is for the purposes of description and should not be regarded as limiting.

DESCRIPTION OF THE PREFERRED EMBODIMENTS

Figure 1:
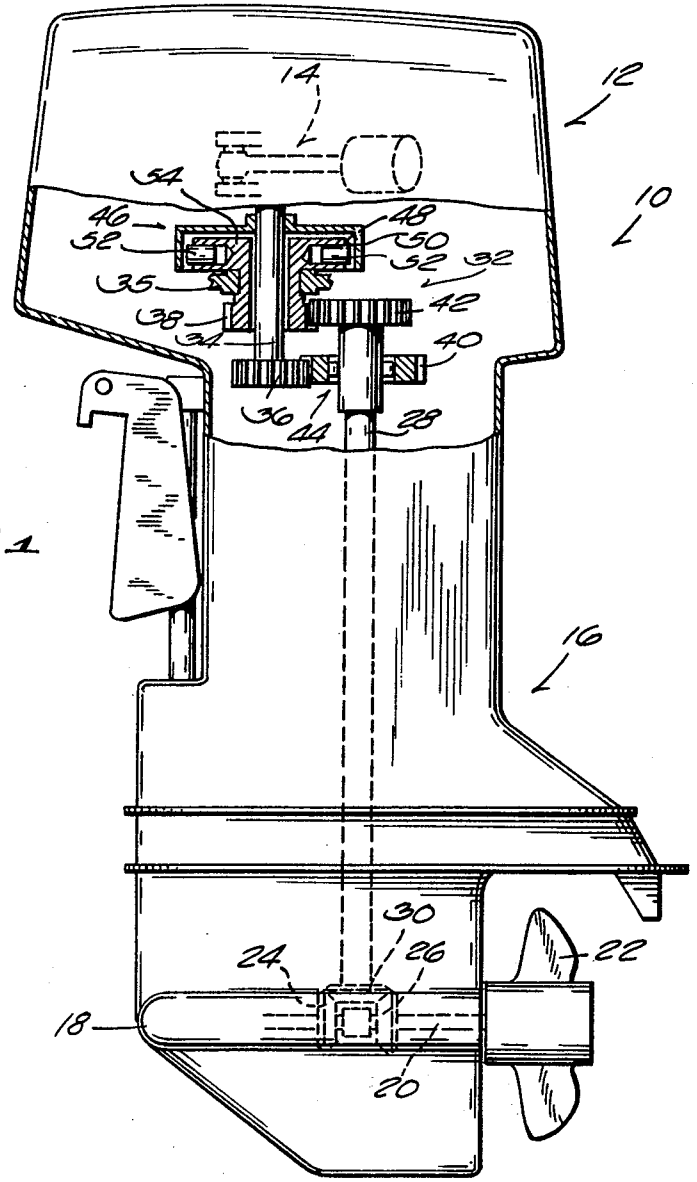
FIG. 1 is a side elevational view, partially broken away and partially in section, of an outboard motor embodying various of the features of the invention.

Illustrated in FIG. 1 is a marine propulsion device, such as an outboard motor 10, including a power head 12 which houses an internal combustion engine 14 and a lower unit 16 having a gear box 18. Rotatably mounted in the gear box 18 is a propeller shaft 20 carrying a propeller 22 on the outer end. Located within the gear box 18 is a pair of facing, axially-spaced gears 24 and 26 which are carried by and are drivingly connected to the propeller shaft 20. Extending through the lower unit 16 is a rotatably mounted drive shaft 28 carrying a lower bevel gear 30 which meshes with the gears 24 and 26. The drive shaft 28 is drivingly connected to the engine 14 through a two-speed transmission, designated generally by the reference numeral 32.

The transmission 32 includes an input shaft 34 which is rotatably mounted such as by a bearing 35 and is drivingly connected to the engine 14, a first drive gear 36 carried by and mounted for common rotation with the input shaft 34, and a second drive gear 38 mounted for rotation coaxially with and independently of the input shaft 34. The transmission 32 also includes a first driven gear 40 which meshes with the first drive gear 36 and is mounted for rotation coaxially with the drive shaft 28 and a second driven gear 42 which meshes with the second drive gear 38 and is mounted for common rotation with the drive shaft 28. For reasons explained below, the gear ratio of the second drive gear 38 to the second driven gear 42 is greater than the gear ratio of the first drive gear 36 to the first driven gear 40.

The first driven gear 40 is drivingly connected to the drive shaft 28 by a suitable one-way, overrunning clutch means 44 disposed therebetween. The one-way clutch means 44 is constructed in the conventional manner so a detailed description of its structural features and mode of operation is not necessary for full understanding of the invention. Generally, the one-way clutch means 44 is arranged so that, in response to rotation of the first driven gear 40 via the first drive gear 36 and the input shaft 34, it drives the drive shaft 28 in one rotary direction. Further, the one-way clutch means 44 is arranged so that, when the rotational speed of the drive shaft 28 in the one rotary direction exceeds the rotational speed of the first drive gear 40 in the same rotary direction (i.e., when the drive shaft 28 overruns the first driven gear 40), the drive shaft 28 becomes free wheeling relative to the first driven gear 40.

For example, the one-way clutch means 44 can include teeth or lugs (not shown) which are drivingly connected to the first driven gear 40, which are biased into driving engagement with complementary teeth or lugs (not shown) provided on the drive shaft 28, and which are disengaged from the drive shaft teeth or lugs when overrunning occurs.

Carried on the input shaft 34 is a centrifugal clutch which is operable, in response to rotation of the input shaft 34 above a predetermined speed, to drivingly connect the second drive gear 38 to the input shaft 34.

While various arrangements can be used, in the specific construction illustrated, there is provided a centrifugal clutch 46 including a clutch drum 48 which has a cylindrical inner surface 50 and is mounted for common rotation with the input shaft 34. The clutch 46 also has two or more clutch shoes 52 carried by a clutch shoe driver 54 which is drivingly connected to the second drive gear 38 and is mounted for rotation coaxially with and independently of the input shaft 34. The clutch shoe driver 54 rotates the clutch shoes 52, in response to rotation of the second drive gear 38, and is arranged in a suitable manner to cause the clutch shoes 52 to move radially between an inner or retracted position spaced from the clutch drum 48 and an outer or extended position in driving engagement with the clutch drum inner surface 50 when the second drive gear 38 is rotated at a speed corresponding to the predetermined input shaft speed.

The clutch shoes 52 can be constructed in any suitable manner including an arcuate surface adapted to drivingly engage the inner surface 50 of the clutch drum 48 when the clutch shoe driver 54 is rotated at a speed corresponding to the predetermined input shaft speed. Outward movement of the clutch shoes 52 from the retracted position, in absence of rotation of the clutch shoe driver above the predetermined speed, is restrained by a suitable means (not shown).

In operation, when the input shaft 34 is being rotated at low or moderate speeds, the drive shaft 28, and thus the propeller 22, is driven by the input shaft 34 via the first drive gear 36, the first driven gear 40, and the one-way clutch means 44. The second drive gear 38 is also being driven by the second driven gear 40 at this time but is free wheeling relative to the input shaft 34 because the clutch shoe driver 54 is being rotated at a speed less than the predetermined speed at which the clutch shoes 52 are moved radially outwardly to the extended position.

When the engine speed is increased to a point where the clutch shoe driver 54 is rotated above the predetermined speed, the clutch shoes 52 drivingly engage the inner surface 50 of the clutch drum 48 to drivingly connect the second drive gear 38 to the input shaft 34. The second drive gear 38 thereafter drives the second driven gear 42.

Since the gear ratio between the second drive gear 38 and the second driven gear 42 is greater than the gear ratio between the first drive gear 36 and the first driven gear 40, the drive shaft 28 is rotated at a rate faster than the rate of rotation of the first driven gear 40, causing the one-way clutch means 44 to disengage so that the drive shaft 28 is free wheeling relative to the first driven gear 40. The drive shaft 28 thereafter is driven by the input shaft 34 via the centrifugal clutch 46, the second drive gear 38 and the second driven gear 42.

When the engine speed is decreased to a point where the rate of rotation of the clutch shoe driver 54 falls below the predetermined speed, the clutch shoes 52 return toward the retracted position (i.e., disengage from the clutch drum 48), thereby disconnecting the second drive gear 38 from the input shaft 34 and causing a reduction in the rate of rotation of the drive shaft 28 to a speed where the one-way clutch means 44 re-engages. The drive shaft 28 thereafter is driven by the input shaft 34 via the first drive gear 36, the first driven gear 40, and the one-way clutch means 44.

With this arrangement, a relative large propeller can be used to develop sufficient thrust to get the boat to "go over the hump" on the thrust vs. speed curve with large boat loads or while turning towing skiers and yet the engine will not overspeed at full throttle and maximum boat speed after the boat is planing. That is, the engine 14 can be operated at a high speed while rotating the propeller 22 at a low speed via the input shaft 34, the first drive gear 36, the first driven gear 40, and the one-way clutch means 44, to develop sufficient power or thrust to get the boat "over the hump." Once the boat is planing and less engine power is required to rotate the propeller 22 at maximum speed, the transmission 32 shifts, via the centrifugal clutch 46, to the higher gear ratio provided by the second drive gear 38 and the second driven gear 42, thereby preventing the engine 14 from overspeeding at full throttle and maximum boat speed. Thus, smaller, more economical engines can be used for carrying heavy loads or towing water skiers, which tasks normally require larger engines to get the boat "over the hump" and into planing trim.

Further, the two-speed transmission 32 can be advantageously used in propulsion units for racing boats. The transmission permits the engine to rapidly turn up to higher r.p.m.'s while accelerating out of a turn and then shifts, after the boat is planing, to facilitate top speed operation. When a centrifugal clutch is employed as in the embodiment illustrated in FIG. 1, this shifting is accomplished automatically without any effort on the part of the driver and higher lap speeds normally can be obtained for a given engine.

FIG. 2 illustrates another embodiment of the invention including various components which are constructed and arranged in a manner similar to the embodiment illustrated in FIG. 1. Thus, the same reference numerals have been assigned to common components.

The basic difference between the marine propulsion unit 60 shown in FIG. 2 and the marine propulsion unit 10 shown in FIG. 1 is that the former employs dual drive shafts instead of a single drive shaft. The use of dual drive shafts affords the use of smaller drive gears to impart the same power to the propeller and thus less frontal area for the gear case 18 and/or smaller size of the portion of the housing enclosing the upper end of the drive shafts.

Located within the gear box 18 and drivingly connected to the propeller shaft 20 are a pair of bevel gears 62 which can be a unitary element as illustrated or separate gears. Extending through the lower unit 16 is a first rotatably mounted drive shaft 16 which is similar to the drive shaft 28 in FIG. 1 and carries a lower bevel gear 66 which meshes with one of the gears 62. Extending through the lower unit 16 in parallel relationship to the first drive shaft 64 in a second rotatably mounted drive shaft 68 carrying a lower bevel gear 70 which meshes with the other of the gears 62. The first and second drive shafts 64 and 68 are drivingly connected to the engine by a two-speed transmission **32*a* which is constructed and operates in the same basic manner as the transmission 32 in FIG. 1, except that the second driven gear 42*a*, in addition to meshing with the second drive gear 38, also meshes with a third driven gear 72 mounted on the upper end of the second drive shaft 68** for common rotation therewith.

In operation, when the input shaft 34 is being rotated at low or moderate speeds, the first drive shaft 64 is driven by the input shaft 34 via the first drive gear 36, the first driven gear 40, and the one-way clutch means 44. The second drive shaft 68 is driven by the input shaft 34 via the first drive gear 36, the first driven gear 40, the one-way clutch means 44, the second driven gear **42*a* and the third driven gear 72 to effect counter rotation of the drive shafts 64 and 68 and the gears 66 and 70. The second drive gear 38 is also being driven by the second driven gear 42*a* at the same time but is free wheeling relative to the input shaft 34 because the clutch shoe driver 54 is being rotated at a speed less than the speed at which the clutch shoes 52** are moved radially outwardly to an extended position.

When the engine speed is increased to a point where the clutch shoe driver 54 is rotated above the predetermined speed, the clutch shoes 52 engage the clutch drum 48 to drivingly connect the second drive gear 38 to the input shaft 34, causing the transmission **32*a* to shift as described above. The drive shafts 64 and 68 thereafter are driven by the input shaft 34 via the centrifugal clutch 46, the second drive gear 38 and the respective second driven gear 42*a* and third driven gear 72**. When the engine speed is decreased, the transmission shifts back to the lower gear ratio as described above.

While a centrifugal clutch has been illustrated and described, and generally is preferred because automatic shifting is afforded, it is within the scope of the invention to employ a suitable manually shiftable clutch for selectively connecting the second driven gear 38 to the input shaft 34. Although the two-speed transmission of the invention has been described for use on an outboard motor, it should be understood that it can be used in other marine propulsion devices, such as stern drive units, and in other similar applications.

Further, while the transmission has been illustrated and described as being located in the powerhead, immediately below the engine and above the drive shaft and on the top of the drive shaft housing, it can be located in the lower unit above the gear box, such as in the lower end portion of the drive shaft housing connected to the gear box.

Various of the features of the invention are set forth in the following claims.

What is claimed is:

1. A marine propulsion device comprising an input shaft drivingly connected to a power source, a lower unit having a rotatably mounted drive shaft, a propeller shaft rotatably mounted in said lower unit and carrying a propeller, means drivingly connecting said drive shaft to said propeller shaft, and a two-speed transmission drivingly connecting said input shaft to said drive shaft and including a first drive gear mounted for common rotation with said input shaft, a second drive gear mounted for rotation coaxially with and independently of said input shaft, a first driven gear mounted for rotation coaxially with said drive shaft and disposed in enmeshing engagement with said first drive gear, the gear ratio of said first drive gear to said first driven gear having a first value, a second driven gear mounted for common rotation with said drive shaft and disposed in enmeshing engagement with said second drive gear, the gear ratio of said second drive gear to said second driven gear having a second value greater than said first value, first clutch means operable for drivingly connecting said first driven gear to said drive shaft to afford rotation of said drive shaft in one rotary direction through said first drive and driven gears and to permit rotation of said drive shaft relative to said first driven gear when said drive shaft is rotated in said one rotary direction at a rate of rotation greater than the rate of rotation of said first driven gear, and second clutch means for selectively drivingly connecting said second drive gear to said input shaft, whereby said drive shaft thereafter is rotated in said one rotary direction, in response to rotation of said input shaft, through said second drive and driven gears and independently of said first drive and driven gears.

2. A marine propulsion device according to claim 1 wherein said second clutch means is operable, in response to rotation of said input shaft, to drivingly connect said second driven gear to said input shaft when said input shaft is rotated above a predetermined speed.

3. A marine propulsion device according to claim 2 wherein said second clutch means comprises a centrifugal clutch carried by said input shaft and including means operable, in response to rotation of said second drive gear by said second driven gear, for drivingly connecting said second drive gear to said input shaft when the rotational speed of said second driven gear exceeds a speed corresponding to said predetermined speed.

4. A marine propulsion device according to claim 3 wherein said centrifugal clutch includes a clutch drum mounted for common rotation with said input shaft, a plurality of clutch shoes, and a clutch shoe driver mounted for common rotation with said second drive gear and for rotation independently of said input shaft, said clutch shoe driver carrying said clutch shoes and operable, in response to rotation of said second drive gear, for rotatably driving said clutch shoes so as to cause radially outward movement of said clutch shoes from a retracted position spaced from said clutch drum to an extended position in driving engagement with said clutch drum.

5. A marine propulsion device comprising an input shaft drivingly connected to a power source, a lower unit including a rotatably mounted propeller shaft carrying a propeller, first and second drive shafts rotatably mounted in said lower unit and drivingly connected to said propeller shaft, and a two-speed transmission drivingly connecting said input shaft to said first and second drive shafts and including a first drive gear mounted for common rotation with said input shaft, a second drive gear mounted for rotation coaxially with and independently of said input shaft, a first driven gear mounted for rotation coaxially with said first drive shaft and disposed in enmeshing engagement with said first driven gear, the gear ratio of said first drive gear to said first driven gear having a first value, a second driven gear mounted for common rotation with said first drive shaft and disposed in enmeshing engagement with said second drive gear, the gear ratio of said second drive gear to said second driven gear having a second value greater than said first value, a third driven gear mounted for rotation common with said second drive shaft and disposed in enmeshing engagement with said second driven gear, first clutch means operable for drivingly connecting said first driven gear to said first drive shaft to afford rotation of said first drive shaft in one rotary direction through said first drive and driven gears, to afford rotation of said second drive shaft in a rotary direction opposite to said one direction through said first drive and driven gears, said second driven gear, and said third driven gear, and to permit rotation of said first drive shaft relative to said first driven gear when said first drive shaft is rotated in said one rotary direction at a rate of rotation greater than the rate of rotation of said first driven gear, and second clutch means for selectively drivingly connecting said second drive gear to said input shaft whereby said first drive shaft thereafter is rotated in said one rotary direction, in response to rotation of said input shaft, through said second drive and driven gears and independently of said first drive and driven gears and whereby said second drive shaft thereafter is rotated in a rotary direction opposite to said one rotary direction, in response to rotation of said input shaft, through said second drive gear, said second driven gear and said third driven gear.

6. A marine propulsion device according to claim 5 wherein said second clutch means is operable, in response to rotation of said input shaft, to drivingly connect said second driven gear to said input shaft when said input shaft is rotated above a predetermined speed.

7. A marine propulsion device according to claim 6 wherein said second clutch means comprises a centrifugal clutch carried by said input shaft and including means operable, in response to rotation of said second drive gear by said second driven gear, for drivingly connecting said second drive gear to said input shaft when the rotational speed of said second driven gear exceeds a speed corresponding to said predetermined speed.

8. A marine propulsion device according to claim 7 wherein said centrifugal clutch includes a clutch drum mounted for common rotation with said input shaft, a plurality of clutch shoes, and a clutch shoe driver mounted for common rotation with said second drive gear and for rotation independently of said input shaft, said clutch shoe driver carrying said clutch shoes and operable, in response to rotation of said second driven gear, for rotatably driving said clutch shoes so as to cause radially outward movement of said clutch shoes from a retracted position spaced from said clutch drum to an extended position in driving engagement with said clutch drum.

9. A two-speed transmission including an input shaft adapted for connection to a power source, a drive shaft, a first drive gear mounted for common rotation with said input shaft, a second drive gear mounted for rotation coaxially with and independently of said input shaft, a first driven gear mounted for rotation coaxially with said drive shaft and disposed in enmeshing engagement with said first drive gear, the gear ratio of said first drive gear to said first driven gear having a first value, a second driven gear mounted for common rotation with said drive shaft and disposed in enmeshing engagement with said second drive gear, the gear ratio of said second drive gear to second driven gear having a second value greater than said first value, first clutch means operable for drivingly connecting said first driven gear to said drive shaft to afford rotation of said drive shaft in one rotary direction through said first drive and driven gears and to permit rotation of said drive shaft relative to said first driven gear when said drive shaft is rotated in said one rotary direction at a rate of rotation greater than the rate of rotation of said first driven gear, and second clutch means for selectively drivingly connecting said second drive gear to said input shaft whereby said drive shaft thereafter is rotated in said one rotary direction, in response to rotation of said input shaft, through said second drive and driven gears and independently of said first drive and driven gears.

10. A two-speed transmission according to claim 9 wherein said second clutch means is operable, in response to rotation of said input shaft, to drivingly connect said second driven gear to said input shaft when said input shaft is rotated above a predetermined speed.

11. A two-speed transmission according to claim 10 wherein said second clutch means comprises a centrifugal clutch carried by said input shaft and including means operable, in response to rotation of said second drive gear by said second driven gear, for drivingly connecting said second drive gear to said input shaft when the rotational speed of said second driven gear exceeds a speed corresponding to said predetermined speed.

12. A two-speed transmission according to claim 11 wherein said centrifugal clutch includes a clutch drum mounted for common rotation with said input shaft, a plurality of clutch shoes, and a clutch shoe driver mounted for common rotation with said second drive gear and for rotation independently of said input shaft, said clutch shoe driver carrying said clutch shoes and operable, in response to rotation of said second drive gear, for rotatably driving said clutch shoes so as to cause radially outward movement of said clutch shoes from a retracted position spaced from said clutch drum to an extended position in driving engagement with such clutch drum.

13. A marine propulsion device comprising an input shaft drivingly connected to a power source, a lower unit having a rotatably mounted drive shaft, a propeller shaft rotatably mounted in said lower unit and carrying a propeller, means drivingly connecting said drive shaft to said propeller shaft, and a two-speed transmission drivingly connecting said input shaft to said drive shaft and including a first drive gear fixed to said input shaft for common rotation with said input shaft, a second drive gear mounted for rotation coaxially with and independently of said input shaft, a first driven gear mounted for rotation coaxially with and independently of said drive shaft and disposed in enmeshing engagement with said first drive gear, the gear ratio of said first drive gear to said first driven gear having a first value, a second driven gear fixed to said drive shaft for common rotation with said drive shaft and disposed in enmeshing engagement with said second drive gear, the gear ratio of said second drive gear to said second driven gear having a second value greater than said first value, first clutch means operable for drivingly connecting said first driven gear to said drive shaft to afford rotation of said drive shaft in one rotary direction through said first drive and driven gears and to permit rotation of said drive shaft relative to said first driven gear when said drive shaft is rotated in said one rotary direction at a rate of rotation greater than the rate of rotation of said first driven gear, and second clutch means for selectively drivingly connecting said second drive gear to said input shaft when said input shaft is rotated above a predetermined speed, said second clutch means comprising a centrifugal clutch including a clutch drum mounted for common rotation with said input shaft, a plurality of clutch shoes, and a clutch shoe driver mounted for common rotation with said second drive gear and for rotation independently of said input shaft, said clutch shoe driver carrying said clutch shoes and being operable, in response to rotation of said second drive gear, for rotatably driving said clutch shoes so as to cause radially outward movement of said clutch shoes from a retracted position spaced from said clutch drum to an extended position in driving engagement with said clutch drum.

14. A marine propulsion device comprising an input shaft drivingly connected to a power source, a lower unit including a rotatably mounted propeller shaft carrying a propeller, first and second drive shafts rotatably mounted in said lower unit and drivingly connected to said propeller shaft, and a two-speed transmission drivingly connecting said input shaft to said first and second drive shafts and including a first drive gear fixed to said input shaft for common rotation with said input shaft, a second drive gear mounted for rotation coaxially with and independently of said input shaft, a first driven gear mounted for rotation coaxially with and independently of said first drive shaft and disposed in enmeshing engagement with said first driven gear, the gear ratio of said first drive gear to said first driven gear having a first value, a second driven gear fixed on said first drive shaft for common rotation with said first drive shaft and disposed in enmeshing engagement with said second drive gear, the gear ratio of said second drive gear to said second driven gear having a second value greater than said first value, a third driven gear fixed for rotation in common with said second drive shaft and disposed in enmeshing engagement with said second driven gear, first clutch means operable for drivingly connecting said first driven gear to said first drive shaft to afford rotation of said first drive shaft in one rotary direction through said first drive and driven gears, and to permit rotation of said first drive shaft relative to said first driven gear when said first drive shaft is rotated in said one rotary direction at a rate of rotation greater than the rate of rotation of said first driven gear, and second clutch means for selectively drivingly connecting said second drive gear to said input shaft when said input shaft is rotated above a predetermined speed, said second clutch means comprising a centrifugal clutch including a clutch drum mounted for common rotation with said input shaft, a plurality of clutch shoes, and a clutch shoe driver mounted for common rotation with said second drive gear and for rotation independently of said input shaft, said clutch shoe driver carrying said clutch shoes and being operable, in response to rotation of said second drive gear, for rotatably driving said clutch shoes so as to cause radially outward movement of said clutch shoes from a retracted position spaced from said clutch drum to an extended position in driving engagement with said clutch drum.

15. A two-speed transmission including an input shaft adapted for connection to a power source, a drive shaft, a first drive gear fixed to said input shaft for common rotation with said input shaft, a second drive gear mounted for rotation coaxially with and independently of said input shaft, a first driven gear mounted for rotation coaxially with and independently of said drive shaft and disposed in enmeshing engagement with said first drive gear, the gear ratio of said first drive gear to said first driven gear having a first value, a second driven gear fixed to said drive shaft for common rotation with said drive shaft and disposed in enmeshing engagement with said second drive gear, the gear ratio of said second drive gear to second driven gear having a second value greater than said first value, first clutch means operable for drivingly connecting said first driven gear to said drive shaft to afford rotation of said drive shaft in one rotary direction through said first drive and driven gears and to permit rotation of said drive shaft relative to said first driven gear when said drive shaft is rotated in said one rotary direction at a rate of rotation greater than the rate of rotation of said first driven gear, and second clutch means for selectively drivingly connecting said second drive gear to said input shaft when said input shaft is rotated above a predetermined speed, said second clutch means comprising a centrifugal clutch including a clutch drum mounted for common rotation with said input shaft, a plurality of clutch shoes, and a clutch shoe driver mounted for common rotation with said second drive gear and for rotation independently of said input shaft, said clutch shoe driver carrying said clutch shoes and being operable, in response to rotation of said second drive gear, for rotatably driving said clutch shoes so as to cause radially outward movement of said clutch shoes from a retracted position spaced from said clutch drum to an extended position in driving engagement with said clutch drum.

16. A marine propulsion device comprising an input shaft drivingly connected to a power source, a lower unit having a rotatably mounted drive shaft, a propeller shaft rotatably mounted in said lower unit and carrying a propeller, means drivingly connecting said drive shaft to said propeller shaft, and a two-speed transmission drivingly connecting said input shaft to said drive shaft and including first drive means between said input shaft and said drive shaft for selectively drivingly connecting said input shaft and said drive shaft at all input speeds and including a drive gear, a driven gear in meshing engagement with said drive gear, and a one-way overrunning clutch drivingly connecting said input shaft and said drive shaft through said drive and driven gears when the rotational speed of said input shaft is less than a predetermined value, said first drive means having an input-output speed ratio with a first value, and second drive means for selectively drivingly connecting said input shaft and said drive shaft when the rotational speed of said input shaft is greater than said predetermined value, said second drive means including a selectively actuatable clutch for drivingly connecting said input shaft and said drive shaft, said second drive means having an input-output speed ratio with a second value greater than said first value.

17. A marine propulsion device in accordance with claim 16 wherein said input shaft and said drive shaft are axially offset.

18. A marine propulsion device in accordance with claim 16 wherein said second drive means includes a second drive gear and a second driven gear in meshing engagement with said second drive gear.

19. A marine propulsion device in accordance with claim 16 wherein said second drive means clutch comprises a centrifugal clutch including a drum drivingly connected to one of said input shaft and said drive shaft and a driver drivingly connected to the other of said input shaft and said drive shaft and operable in response to driver rotation above a predetermined speed to effect driving engagement between said driver and said drum and therefore between said input shaft and said drive shaft.

20. A marine propulsion device in accordance with claim 16 and further including a second drive shaft rotatably mounted in said lower unit and drivingly connected to said propeller shaft, and means adjacent said first and second drive means for drivingly connecting said first mentioned drive shaft to said second drive shaft for transmissions of power to said propeller shaft through said first mentioned and second drive shaft.

* * * * *